US006657609B2

(12) United States Patent
Starr

(10) Patent No.: US 6,657,609 B2
(45) Date of Patent: Dec. 2, 2003

(54) LIQUID CRYSTAL DISPLAYS WITH REDUCED FLICKER

(75) Inventor: Michael J. Starr, Brewster, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 229 days.

(21) Appl. No.: 09/965,185

(22) Filed: Sep. 28, 2001

(65) Prior Publication Data

US 2003/0063047 A1 Apr. 3, 2003

(51) Int. Cl.[7] ..... G09G 3/36
(52) U.S. Cl. ..... 345/94; 345/60; 348/761
(58) Field of Search ..... 345/60, 94, 96, 345/99, 98, 100, 208, 209, 213, 87; 348/750, 751, 761

(56) References Cited

U.S. PATENT DOCUMENTS 5,387,953 A * 2/1995 Minoura et al. ..... 353/20
5,457,474 A * 10/1995 Ikeda ..... 345/92
5,489,910 A * 2/1996 Kuwata et al. ..... 345/212
5,663,775 A * 9/1997 Kawamura et al. ..... 348/751
5,793,446 A * 8/1998 Nose et al. ..... 348/751
5,838,287 A * 11/1998 Kuijk ..... 345/58

* cited by examiner

*Primary Examiner*—Kent Chang

(57) ABSTRACT

A method and apparatus of reducing flicker in liquid crystal displays. A light beam modulated by image information organized by frames is produced. In alternating frames, designed as even and odd frames, the light beam is modulated use complementary voltages relative to a common electrode. The difference in the average modulation in the even frames and in the odd frames over time is determined. That difference is used to adjust the potential of the common electrode such that the difference in the average modulation over time becomes zero.

14 Claims, 4 Drawing Sheets

LIQUID CRYSTAL DISPLAYS WITH REDUCED FLICKER

BACKGROUND OF THE INVENTION

1. Field of the Invention

The present invention relates to liquid crystal displays. More specifically, it relates to reducing flicker in reflective liquid crystal display devices.

2. Discussion of the Related Art

Producing a color image using a Liquid Crystal Display (LCD) is well known. Such displays are particularly useful for producing images that are updated by frames, such as in color televisions. Typically, each image frame is composed of color sub-frames, usually red, green and blue sub-frames.

Such LCD systems employ a light crystal light panel that is comprised of a large number of individual liquid crystal pixel elements. Those pixel elements are beneficially organized in a matrix comprised of pixel rows and pixel columns. To produce a desired image, the individual pixel elements are modulated in accordance with image information. Typically, the image information is applied to the individual pixel elements by rows, with each pixel row being addressed in each frame period.

Pixel element matrix arrays are preferably "active" in that each pixel element is connected to an active switching element of a matrix of such switching elements. One particularly useful active matrix liquid crystal display is the reflective active-matrix liquid crystal display (RLCD). An RLCD display is typically produced on a silicon substrate and is often based on the twisted nematic (TN) effect. Thin film transistors (TFTs) are usually used as the active switching elements. Such RLCD displays can support a high pixel density because the TFTs and their interconnections can be integrated onto the silicon substrate.

FIG. 1 schematically illustrates a single pixel element 10 of a typical RLCD. The pixel element 10 is comprised of a twisted nematic liquid crystal layer 12 that is disposed between a transparent electrode 14 and a pixel electrode 16. For convenience, FIG. 1 shows the transparent electrode applied to a common ground. However, in practice the transparent electrode is usually biased, say at +7 volts. Additionally, a storage element 18 is connected to complementary data terminals 20 and 22. The storage element receives control signals on a control terminal 24. In responsive to a "write" control signal the storage element 18 selectively latches the voltage on one of the data terminals 20 and 22, and applies that latched voltage to the pixel electrode 16 via a signal line 26. The voltages on the data terminals 20 and 22 are complementary. That is, if the transparent electrode is at ground, when one line is at +2 volts, the other is at −2 volts. Still referring to FIG. 1, and as explained in more detail subsequently, the liquid crystal layer 12 rotates the polarization of the light 30, with the amount of polarization rotation dependent on the voltage across the liquid crystal layer 12. Ideally, the pixel element 10 is symmetrical in that the polarization rotation depends only on the magnitude of the latched signal on the signal line 26. By alternating complementary signals in consecutive frames, unwanted charges across the liquid crystal layer 12 are prevented. If only one polarity was used, ions would build up across the capacitance formed by the transparent electrode 14, the liquid crystal layer 12, and the pixel electrode 16. Such charges would bias the pixel element 10. Thus, the pixel elements are driven by complementary signals in consecutive frame periods. Those frame periods are thus grouped into even frames and odd frames, with the even and odd frames being interlaced.

The light 30 is derived from incident non-polarized light 32 from an external light source (which is not shown). The non-polarized light is polarized by a first polarizer 34 to form the light 30. The light 30 passes through the transparent electrode 14, through the liquid crystal layer 12, reflects off the pixel electrode 16, passes back through the liquid crystal layer 12, passes out of the transparent electrode 14, and then is directed onto a second polarizer 36. During the double pass through the liquid crystal layer 12 the polarization of the light beam is rotated in accord with the magnitude of the voltage on the signal line 26. Only the portion of the light 30 that is parallel with the polarization direction of the second polarizer 36 passes through that polarizer. Since the passed portion depends on the amount of polarization rotation, which in turn depends on the voltage on the signal line 26, the voltage on the signal line controls the intensity of the light that leaves the pixel element.

The storage element 18 is typically a capacitor connected to a thin film transistor switch. When a control signal is applied to the gate electrode of the thin film transistor that transistor turns on. Then, the voltage applied to the source of the thin film transistor passes through the thin film transistor and charges the capacitor. When the control signal is removed, the thin film transistor opens and the capacitor potential is stored on the pixel electrode 16.

FIG. 2 schematically illustrates a pixel element matrix. As shown, a plurality of pixel elements 10, each having an associated switching thin film transistor and a storage capacitor, are arranged in a matrix of rows (horizontal) and columns (vertical). For simplicity, only a small portion of a matrix array is shown. In practice there are numerous rows, say 1290, and numerous columns, say 1024. Referring to FIG. 2, the pixel elements of a row are selected together by applying a gate (switch) control signal on a gate line, specifically the gate lines 40*a*, 40*b*, and 40*c*. A constant voltage (which is shared by all of the pixel elements) is applied to the transparent electrode 14 from a ramp source 41 via a line 42. Furthermore, the ramp source 41 applies complementary ramp signals on lines 20 and 22 (which are also shared by all of the pixel elements 10). Furthermore, column select lines 46*a*, 46*b*, and 46*c*, control the operation of the pixel elements 10.

A row of pixel elements is selected by the application of a signal on an appropriate one of the gate lines 40*a*–40*c*. This turns on all of the pixel elements in that row. Then, the ramp source 41 applies a ramp to either line 20 or line 22 (which line is used is varied in each frame). The ramp begins charging all of the storage capacitors in the selected row. As the other rows are not energized, the ramp source only charges the OFF-state capacitance of the other pixels. When the ramp voltage reaches the desired state for a particular pixel, the column select line (46*a*–46*c*) voltage for that particular pixel element 10 turns the pixel switch OFF. Then, the ramp voltage that existed when the particular pixel element 10 was turned OFF is stored on that element's storage capacitor. Meanwhile, the ramp voltage continues to increase until all of the column select lines (46*a*–46*c*) cause a ramp voltage to be HELD on an associated pixel element. After that, a new row of pixel elements is selected and the process starts over. After all rows have been selected, the process starts over again in a new frame period, this time using the complement of the previous ramp.

The foregoing process is generally well known and is typically performed using digital shift registers, microcontrollers, and voltages sources that are beneficially fabricated on a common substrate using semiconductor processing technology on polysilicon and/or amorphous silicon.

While RLCD displays are generally successful, they have their problems. For example, in practice the pixel elements are not ideal in that the polarization rotation of the light 30 is not symmetrical. That is a +1 volt signal does not necessarily produce the same rotation as a −1 volt signal. While the physical principles behind this asymmetry are not fully understood, it appears that one explanation for this phenomenon is that the liquid crystal layer 12, the transparent electrode 14, and the pixel electrode 16 interact to form a battery that biases the pixel electrode 16 relative to the transparent electrode 14. Compounding the problem is the fact that the bias is not constant over time or temperature, and that the bias changes due to manufacturing variations. The result is ion movement that produces a DC voltage offset. The DC voltage offset produces gray scale distortions and limits the achievable gray scale range.

Additionally, the bias offset introduces intensity "flicker" that causes problems that are difficult to correct for. While visual flicker can be minimized by increasing the frame rate such that the human eye does not perceive the flicker, that flicker negatively impacts peak contrast, intensity, and color. Therefore, a technique of correcting for DC bias and/or flicker induced problems would be beneficial.

SUMMARY OF THE INVENTION

Accordingly, the principles of the present invention are directed to a method and to an apparatus of reducing flicker. According to the principles of the present invention a light beam is modulated by image information organized by frames. In alternating frames, designed as even and odd frames, that light beam is modulated use complementary voltages taken relative to a common (transparent) electrode. The difference in the average modulation in the even frames and in the odd frames over time is then determined. That difference is then used to adjust the potential of the common electrode such that the difference in the average modulation over time is zero.

The apparatus includes a beam splitter for passing light having a first polarization and for deflecting light having a second polarization. Polarized light from the beam splitter is modulated by a liquid crystal display driver comprised of a plurality of pixel elements connected in a pixel matrix. Each pixel element includes part of a common transparent electrode, a pixel electrode, and an interposed liquid crystal layer. The liquid crystal display driver modulates its received light, by even and odd frames, to produce a modulated light beam. That modulated light beam is then directed through an optical system that optically modifies the modulated light beam. The optically modified light beam is then displayed on a viewing screen. A light sensor receives a portion of the modulated light beam and produces a sensor signal. That sensor signal is used by correction circuitry to sense a difference in the average modulation of the light beam in even and odd frames. The correction circuitry then adjusts the common transparent electrode potential such that the modulation in the even numbered frames and the modulation in the odd numbered frames have the same average modulation.

Additional features and advantages of the invention will be set forth in the description that follows, and in part will be apparent from that description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate and help explain the principles of the invention.

In the drawings.

DETAILED DESCRIPTION OF THE ILLUSTRATED EMBODIMENT

Reference will now be made in detail to an illustrated embodiment of the present invention, the example of which is provided for in the accompanying drawings. That embodiment illustrates a technique of correcting for liquid crystal pixel element DC bias and/or pixel element flicker-induced problems.

Figure 2:
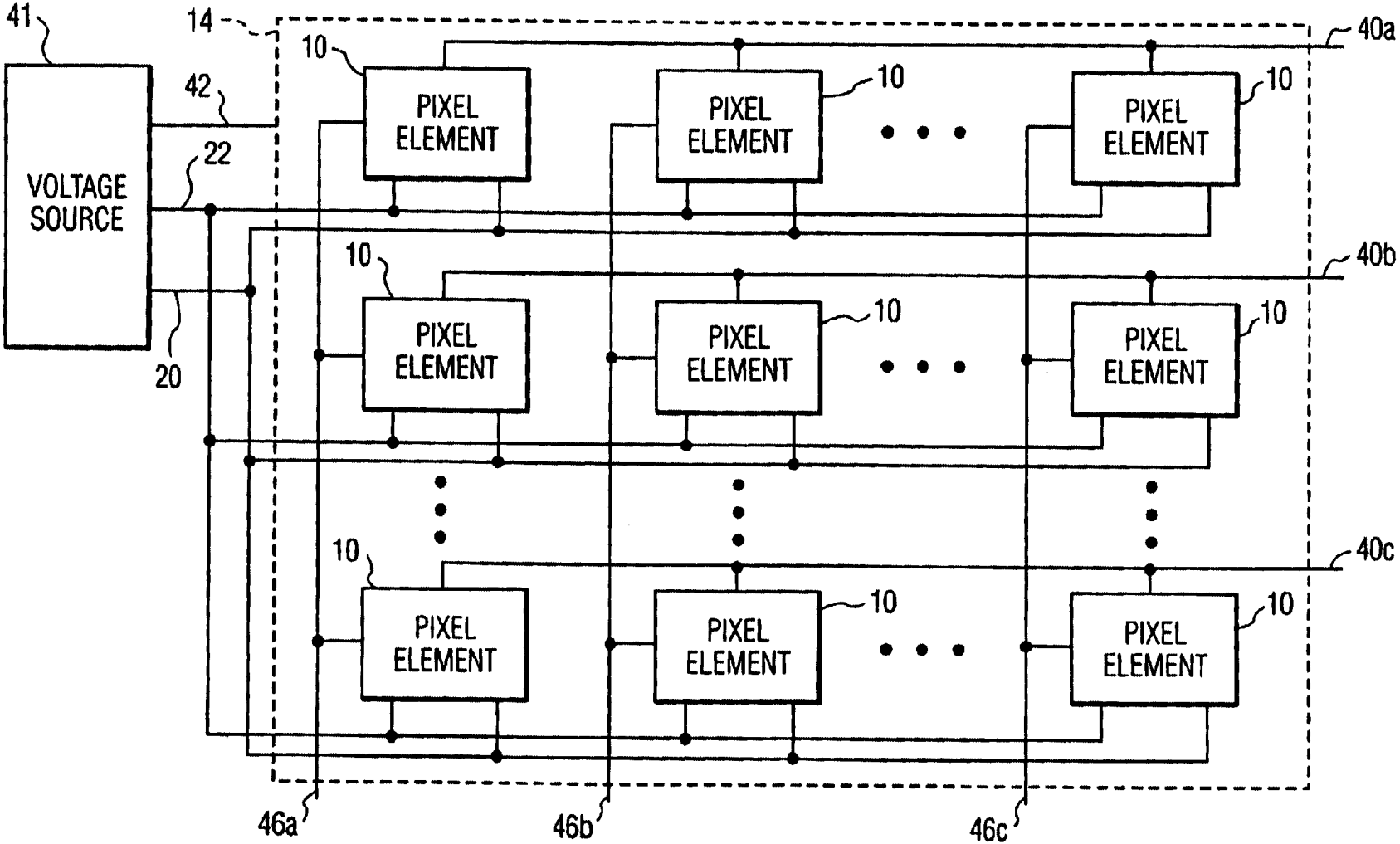
FIG. 2 schematically illustrates a prior art LCD display comprised of a pixel element matrix.
Figure 3:
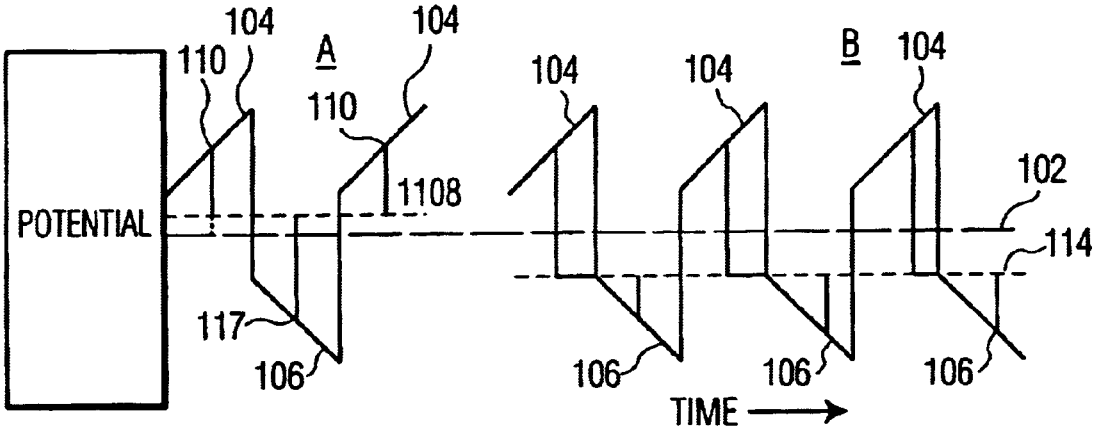
FIG. 3 illustrates exemplary pixel element drive potentials.

FIG. 3 illustrates exemplary pixel element drive potentials verses time that help illustrate the problems that are addressed by the principles of the present invention. FIG. 3 shows an "ideal" reference voltage 102. That ideal reference voltage, which represents the midpoint of positive potentials 104 and negative potentials 106, is the ideal average voltage across the common transparent electrode 14 and the pixel electrode of 16 of FIGS. 1 and 2. Additionally, the positive potentials 104 and negative potentials 106 represent the respective potentials applied to lines 22 and 20 of FIGS. 1 and 2. For example, an ideal reference voltage might be +7 voltage, while the ramp peaks of the positive potentials 104 and negative potentials 106 might reach +12 and +2 volts, respectively.

Figure 1:
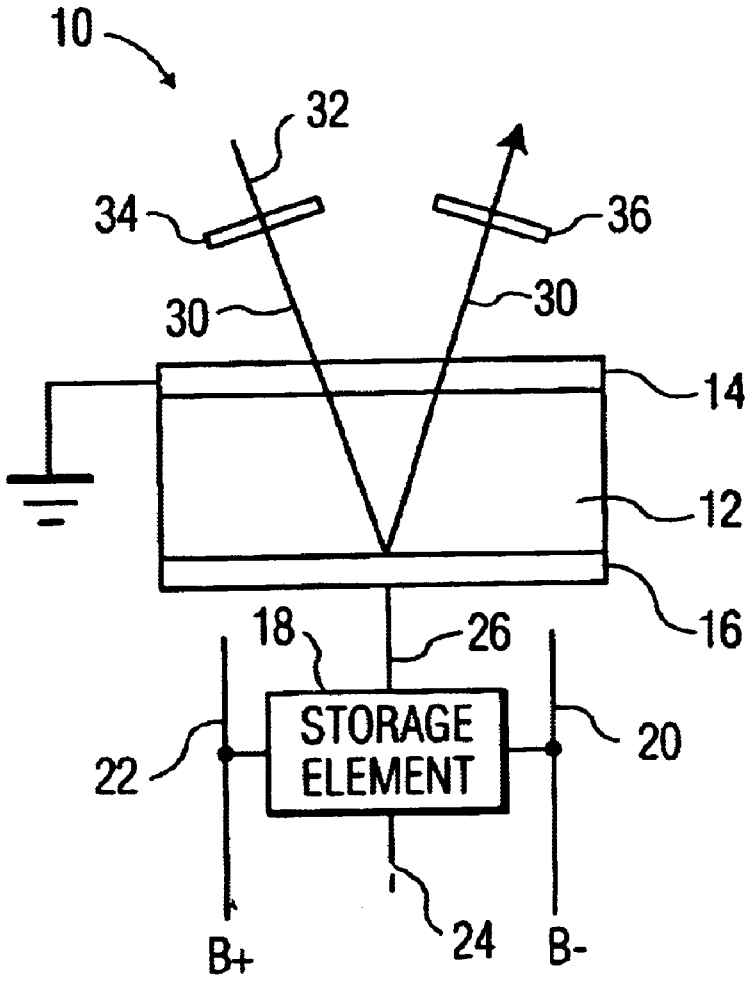
FIG. 1 PRIOR ART
FIG. 1 schematically illustrates a prior art reflective liquid crystal pixel element.

Referring specifically to graph A of FIG. 3, without correction the ideal reference voltage is distorted by the potential of a battery formed by the common transparent electrode 14, the pixel electrode of 16, and the liquid crystal layer 12 (reference FIG. 1). That potential results in an actual reference potential 108. Thus, after a pixel element 10 stores a positive potential 110 in one frame, during the next frame that pixel element stores a negative potential 112 that has a different magnitude than that of the positive potential. In particular, graph A illustrates what happens when the battery potential adds to the ideal reference value. Turning now to graph B, a similar result occurs when the battery potential subtracts from the ideal reference value. In that case, an actual reference potential 114 occurs.

To compensate for the battery potential two factors are required: the magnitude of the required compensation, and the direction of the required compensation. It should be pointed out that battery potential changes tend to occur slowly, typically over a period of many minutes or hours. Thus, rapid corrections are not required. It should be pointed out that the magnitude of the required correction could be measured by the light sensor alone. However, synchronous demodulation can automatically extract not only the magnitude, but also the proper direction for correcting the 'ideal' voltage. Furthermore, the correction direction depends on the specific system. In some systems an increased potential will increase darkness, while in other applications an increased potential will reduce darkness. The synchronous demodulator can be driven to correctly compensate for either system.

Figure 4:
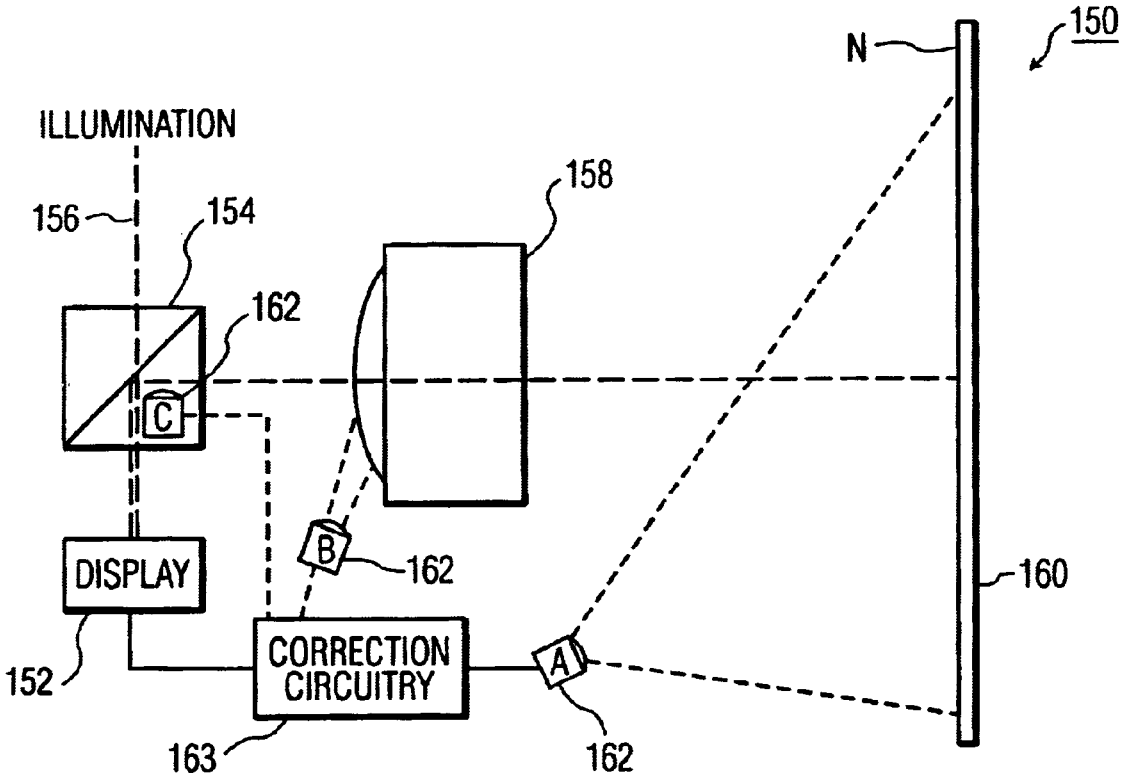
FIG. 4 schematically illustrates a reflective liquid crystal display that incorporates the principles of the present invention.
Figure 5:
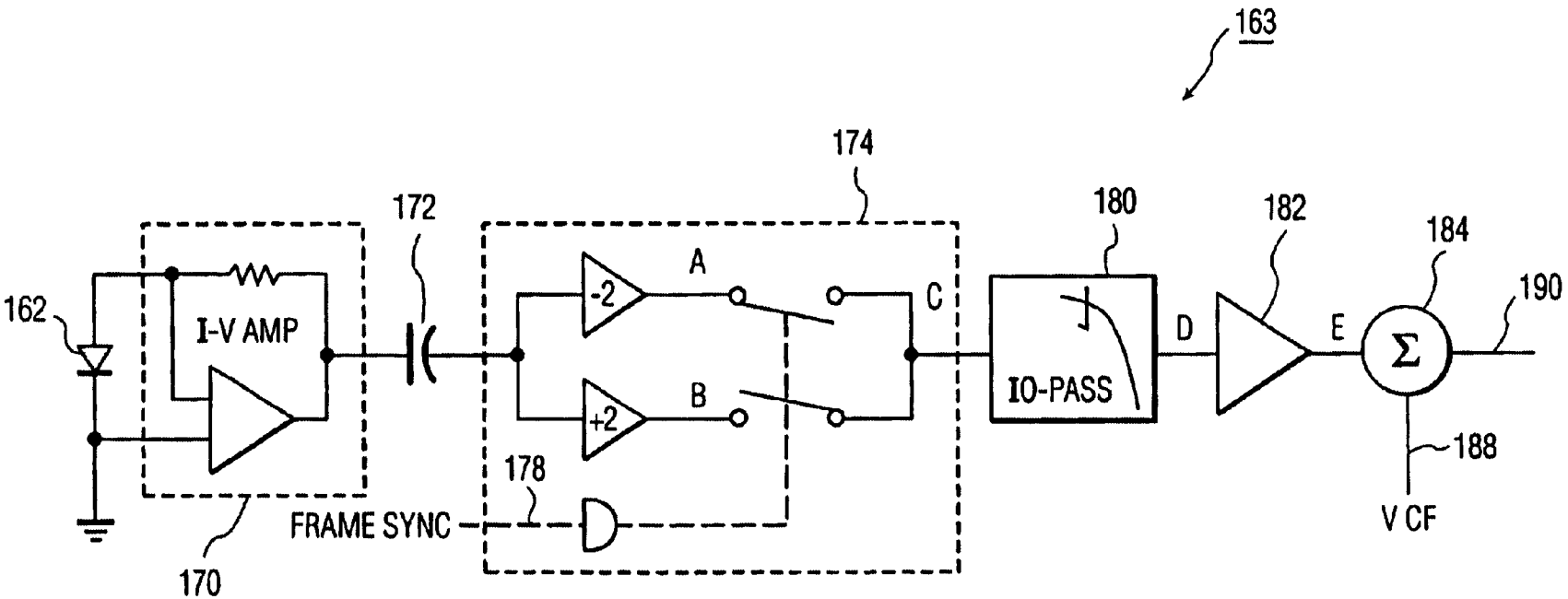
FIG. 5 schematically illustrates electronic circuitry used with the reflective liquid crystal display illustrated in FIG. 4.

FIGS. 4 and 5 schematically illustrate a technique of compensating for the battery potential. Turning now specifically to FIG. 4, a typically RLCD 150 includes a liquid crystal display driver 152, which includes pixel elements and a pixel element matrix as shown in FIGS. 1 and 2, a polarizing beam splitter 154, a source of light 156, a lens system 158, and a viewing screen 160. An RLCD according to the principles of the present invention further includes at least one light sensor 162 that gathers reflected light, and correction circuitry 163. While FIG. 4 shows three light sensors 162, labeled A, B, and C, only one is required. However, there are three particularly good locations to gather reflected light. One is off the viewing screen 160, another is off the lens system 158, and the other is off of the beam splitter of the polarizing beam splitter 154.

In operation, the light 156 passes through the polarizing beam splitter 154 to the display 152. The display 152 varies the polarization rotation of the light 156 and reflects that light back through the polarizing beam splitter 154. The portion of the light 156 having the correct polarization is directed out of the polarizing beam splitter 154 to the lens system 158. Some of the light is reflected at the beam split. That reflected light can be collected by a light sensor 162. The lens system 158 optically processes its incoming light and directs that light onto the viewing screen 160. Some of the light is reflected by the lens system 158 and by the viewing screen 160. Such reflected light can be collected by a light sensor 162.

FIG. 5 illustrates the processing of signals from the light sensor 162 by the correction circuitry 163. The light sensor 162 converts its collected light into an electrical current that is amplified by an amplifier 170. The AC output of the amplifier, which has a relatively high frequency component, passes through a capacitor 172 to a synchronous detector 174. That detector also receives a frame synchronization signal on an input 178. The frame synchronization signal matches the display frame rate. Thus, in one frame period the frame synchronization signal causes switch A to close and switch B to open, and in the next frame period the frame synchronization signal causes switch B to close and switch A to open. The result is an "error signal" that depends on the difference in the intensity of light collected by the light sensor 162 in alternating periods.

Since the error signal can include a high frequency component, the error signal from the synchronous detector 174 is low pass filtered by a filter 180. The output of the filter 180 is amplified by an amplifier 182. The amplified error signal is then applied to a summing circuit 184. The summing circuit 184 also receives a reference potential on a line 188. The summing circuit 184 outputs a control signal on a line 190 that adjusts the potential applied to the transparent electrode 14 (see FIGS. 1 and 2). If an error signal exits, the summing circuit 184 adjusts the control signal on the line 190 in the direction such that the potential applied to the transparent electrode 14 reduces the error signal. When the error signal is zero, the potential applied to the transparent electrode 14 is centered between the positive and negative ramps. This reduces flicker, increases the gray scale, and improves contrast.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display apparatus, comprising:

a beam splitter for passing light having a first polarization and for deflecting light having a second polarization;

a liquid crystal display driver comprised of a plurality of pixel elements connected in a pixel matrix, wherein each pixel element includes a common electrode, a pixel electrode, and an interposed liquid crystal layer, and wherein all pixel elements share a common transparent electrode, said liquid crystal display driver is for receiving light from said beam splitter, said liquid crystal display driver is further for using said pixel elements to modulate the received light according to image information in interlaced even frames and odd frames, wherein modulation during even frames depends on a potential difference between a common electrode voltage on said common electrode and first stored voltages on said pixel electrodes, wherein said first stored voltages are produced by selectively storing potentials of a first ramp in even frames, wherein said modulation during odd frames depends on a potential difference between said common electrode voltage and second stored voltages on said pixel electrodes, wherein said second stored voltages are produced by selectively storing potentials of a second ramp in odd frames;

a lens system for optically modifying said modulated light beam;

a viewing screen for displaying an image produced by said optically modified light beam;

a light sensor for receiving a portion of said modulated light beam and for producing a sensor signal that depends on said received portion; and correction circuitry for receiving said sensor signal and for adjusting said common electrode voltage in response to said sensor signal such that the modulation in said even frames and the modulation in the odd frames have the same average modulation.

2. A liquid crystal display apparatus according to claim 1, wherein said light sensor receives a portion of said modulated light beam that is reflected internal to said beam splitter.

3. A liquid crystal display apparatus according to claim 1, wherein said light sensor receives a portion of said modulated light beam that is reflected by said lens system.

4. A liquid crystal display apparatus according to claim 1, wherein said light sensor receives a portion of said modulated light beam that is reflected by said viewing screen.

5. A liquid crystal display apparatus according to claim 1, wherein said correction circuitry includes an amplifier for amplifying said sensor signal.

6. A liquid crystal display apparatus according to claim 5, wherein said correction circuitry includes a synchronous detector connected to a frame sync signal, and wherein said synchronous detector detects the difference in said amplified sensor signal between the average modulation in said even frames and in said odd frames.

7. A liquid crystal display apparatus according to claim 6, wherein said correction circuitry further includes a low pass filter for filtering high frequency components of said detected difference.

8. A liquid crystal display apparatus according to claim 7, wherein said correction circuitry includes an error correction network for adjusting said common electrode voltage based on said filtered detected difference.

9. A liquid crystal display apparatus according to claim 8, wherein said error correction network receives a reference signal.

10. A method of reducing flicker in a liquid crystal display apparatus, comprising:

producing a modulated light beam in even frames by modulating a light beam's polarization using first potential differences between a common electrode and a plurality of pixel electrodes;

producing a modulated light beam in odd frames by modulating a light beam's polarization using second potential differences between a common electrode and a plurality of pixel electrodes;

passing said modulated light beam in even frames and said modulated light beam in odd frames through an optical system;

imaging the modulated light beams that pass through said optical system on a viewing screen;

sensing a portion of said modulated light beam in even frames and said modulated light beam in odd frames; and using the sensed portion to adjust a reference electrode potential on said common electrode such that said modulated light beam in even frames and said modulated light beam in odd frames having the same average modulation.

11. A method of reducing flicker in a liquid crystal display apparatus according to claim 10, wherein the optical system beam splits and optically processes said modulated light beam in even frames and said modulated light beam in odd frames.

12. A method of reducing flicker in a liquid crystal display apparatus according to claim 10, wherein using the sensed portion includes amplifying and synchronously detecting the sensed portion.

13. A method of reducing flicker in a liquid crystal display apparatus according to claim 10, wherein sensing a portion of said modulated light beam in even frames and said modulated light beam in odd frames includes gathering light reflected from the optical system.

14. A method of reducing flicker in a liquid crystal display apparatus according to claim 10, wherein sensing a portion of said modulated light beam in even frames and said modulated light beam in odd frames includes gathering light reflected from the viewing screen.

* * * * *